US012228004B2

(12) United States Patent
Ganzinotti, III et al.

(10) Patent No.: US 12,228,004 B2
(45) Date of Patent: Feb. 18, 2025

(54) WELLHEAD ASSEMBLY AND TEST SEALING ARCHITECTURE

(71) Applicant: Cameron International Corporation, Houston, TX (US)

(72) Inventors: Edward Ganzinotti, III, Houston, TX (US); Craig Cotton, Cypress, TX (US); Pheng Aun Soh, Singapore (SG); Juan Gonzalez, Houston, TX (US)

(73) Assignee: CAMERON INTERNATIONAL CORPORATION, Houston, TX (US)

( * ) Notice: Subject to any disclaimer, the term of this patent is extended or adjusted under 35 U.S.C. 154(b) by 0 days.

(21) Appl. No.: 17/122,538

(22) Filed: Dec. 15, 2020

(65) Prior Publication Data

US 2021/0189822 A1 Jun. 24, 2021

Related U.S. Application Data

(60) Provisional application No. 62/951,158, filed on Dec. 20, 2019.

(51) Int. Cl.

| | |
|---|---|
| ***E21B 33/03*** | (2006.01) |
| ***E21B 47/06*** | (2012.01) |
| ***E21B 47/117*** | (2012.01) |

(52) U.S. Cl.

CPC ..... *E21B 33/03* (2013.01); *E21B 47/06* (2013.01); *E21B 47/117* (2020.05)

(58) Field of Classification Search

CPC ..... E21B 33/03; E21B 47/06; E21B 47/117

See application file for complete search history.

(56) References Cited

U.S. PATENT DOCUMENTS

| | | | | |
|---|---|---|---|---|
| 4,410,186 | A * | 10/1983 | Pierce, Jr. | F16L 23/167 277/318 |
| 9,644,443 | B1 * | 5/2017 | Johansen | E21B 33/038 |
| 2004/0154790 | A1 * | 8/2004 | Cornelssen | E21B 33/03 166/75.13 |
| 2013/0175039 | A1 * | 7/2013 | Guidry | E21B 43/26 166/379 |
| 2014/0246192 | A1 * | 9/2014 | Guidry | E21B 43/2607 166/250.01 |
| 2018/0010408 | A1 * | 1/2018 | Nguyen | E21B 33/04 |
| 2019/0277137 | A1 * | 9/2019 | Gray | E21B 49/086 |
| 2019/0360292 | A1 * | 11/2019 | Boyd | E21B 34/08 |

* cited by examiner

*Primary Examiner* — Brad Harcourt

(74) *Attorney, Agent, or Firm* — Matthew Goode

(57) ABSTRACT

A wellhead assembly with an external test port for testing a primary seal at an interface of a wellhead and a base. The assembly includes unique architecture with a secondary seal provided adjacent the primary. In this manner, testing of the primary seal from an external location may proceed without concern over a false indication of primary seal failure. That is, for circumstances where a more interior side of the seal fails under pressure testing even though an outer face of the seal might remain in sealing engagement, the secondary seal would ensure that the outer sealing engagement is detected. As a result, a practical manner of testing the wellhead seal from an external location without the need of plugging the wellbore is provided.

11 Claims, 6 Drawing Sheets

WELLHEAD ASSEMBLY AND TEST SEALING ARCHITECTURE

CROSS-REFERENCE TO RELATED APPLICATIONS

The present application claims priority to, and the benefit of the earlier filing date of U.S. Provisional Application No. 62/951,158, titled "Testable Ring Gasket," filed Dec. 20, 2019, the entirety of which is hereby incorporated herein by reference.

BACKGROUND

Exploring, drilling and completing hydrocarbon and other wells are generally complicated, time consuming and ultimately very expensive endeavors. As a result, over the years, well architecture has become more sophisticated where appropriate in order to help enhance access to underground hydrocarbon reserves. For example, in addition to land-based oilfields accommodating wells of limited depth, it is not uncommon to find both on and offshore oilfields with wells exceeding tens of thousands of feet in depth. Furthermore, today's hydrocarbon wells often include a host of lateral legs and fractures which stem from the main wellbore of the well toward a hydrocarbon reservoir in the formation.

In addition to the complexities of the field itself, ongoing management and periodic interventions may be particularly sophisticated undertakings. For example, it is not uncommon for a variety of different wells at a given field to require a variety of different applications and servicing at the same time and throughout production. This may include the simple opening and closing of different valves or a more rigorous undertaking such as the installation of monitoring equipment or the conducting of a cleanout application, just to name a few examples.

In addition to merely producing well fluids from a given well, there may be a substantial amount of monitoring, management and periodic interventions that may take place over time. This means that a variety of different mechanisms and sophisticated architectural features should be maintained and ensured to be operational over the course of the life of the well. For example, a variety of different valves and sealing devices should remain functional throughout the life of the well. Given the level of complexity and sophistication in modern wells, the overall expense of modern well completion and maintenance is often dramatically greater than for well of prior generations. Thus, ensuring even the most basic well components remain safeguarded and operational may be of greater importance, from a dollar standpoint, for more modern wells.

Along these lines, regardless of the level of well architecture and sophistication, one constant in terms of ensuring functional well components involves sealing, such as at the wellhead seal. That is, whether the well is onshore, offshore, of extensive depth, simple or extremely complex architecture, the governing interface to the well, the wellhead, will be landed and sealed at a base entry to the well. The wellhead interface may support a Christmas tree and/or other architectural features that are used to govern production, guide interventions and facilitate other well operations. Thus, ensuring a properly set wellhead seal for isolation of the wellbore is necessary for the ongoing success of well operations.

Presently, as a part of well installation and completions operations, a wellhead seal may be installed and set along with surrounding architecture. Given the importance of the seal in continued functionality of the well, it is generally tested prior to further installations and use of the well. Pressure testing the wellhead seal is currently a simple but time consuming process. Specifically, the wellbore may be plugged below the seal location. Pressure is then applied to the wellbore above the plug. So, for example, where the seal is properly set, an effort to introduce 10,000 PSI of fluid pressure to the wellbore above the plug over the course of several hours should result in the surface detection of 10,000 PSI of pressure. However, where the effort to drive up pressure fails, for example, regardless of the pumping of fluid into the wellbore, it may be due to a leak at the wellhead seal, calling for further inspection and redress where necessary.

Of course, the described manner of testing the wellhead seal is time consuming which doesn't just result in delays, but also in the added expense of plugging and unplugging the main bore. Furthermore, since it is the main bore that is used to test the seal, other aspects of installation are generally halted. Everything regarding the well completion is halted while the time consuming and laborious undertaking of wellhead seal testing takes place. Unfortunately, as a practical matter, there is presently no reliable manner of testing the wellhead seal in some manner other than through the time consuming process of shutting down and relying on the central wellbore.

SUMMARY

A wellhead assembly is disclosed. The assembly includes a primary seal at an interface of the assembly. The primary seal has an outer face and an interior face with the outer face sealingly isolating fluids of a wellbore and defined by a wellhead on a base at the interface. A test port is located at an exterior location of the wellhead with a leak path running therefrom to the primary seal for pressure testing of the outer face. A secondary seal at the interface is located adjacent the primary seal and opposite the leak path to back up the interior face of the primary seal to facilitate the pressure testing.

DETAILED DESCRIPTION

In the following description, numerous details are set forth to provide an understanding of the present disclosure. However, it will be understood by those skilled in the art that the embodiments described may be practiced without these particular details. Further, numerous variations or modifications may be employed which remain contemplated by the embodiments as specifically described.

Embodiments are described with reference to certain land-based oilfield operations. For example, operations in which an onshore well is being installed, completed and tested is illustrated. In the embodiment shown, the wellhead assembly for the well is manually accessible along with an exterior test port for testing of the wellhead seal which is a ring gasket at the interface of the wellhead and base. However, a variety of different well types may take advantage of an exterior test port in this manner. For example, even subsea wells may take advantage of such wellhead architecture. Indeed, so long as the wellhead assembly includes an exterior test port for testing of an internal primary seal in combination with a secondary seal to facilitate the testing, appreciable benefit may be realized.

Figure 1:
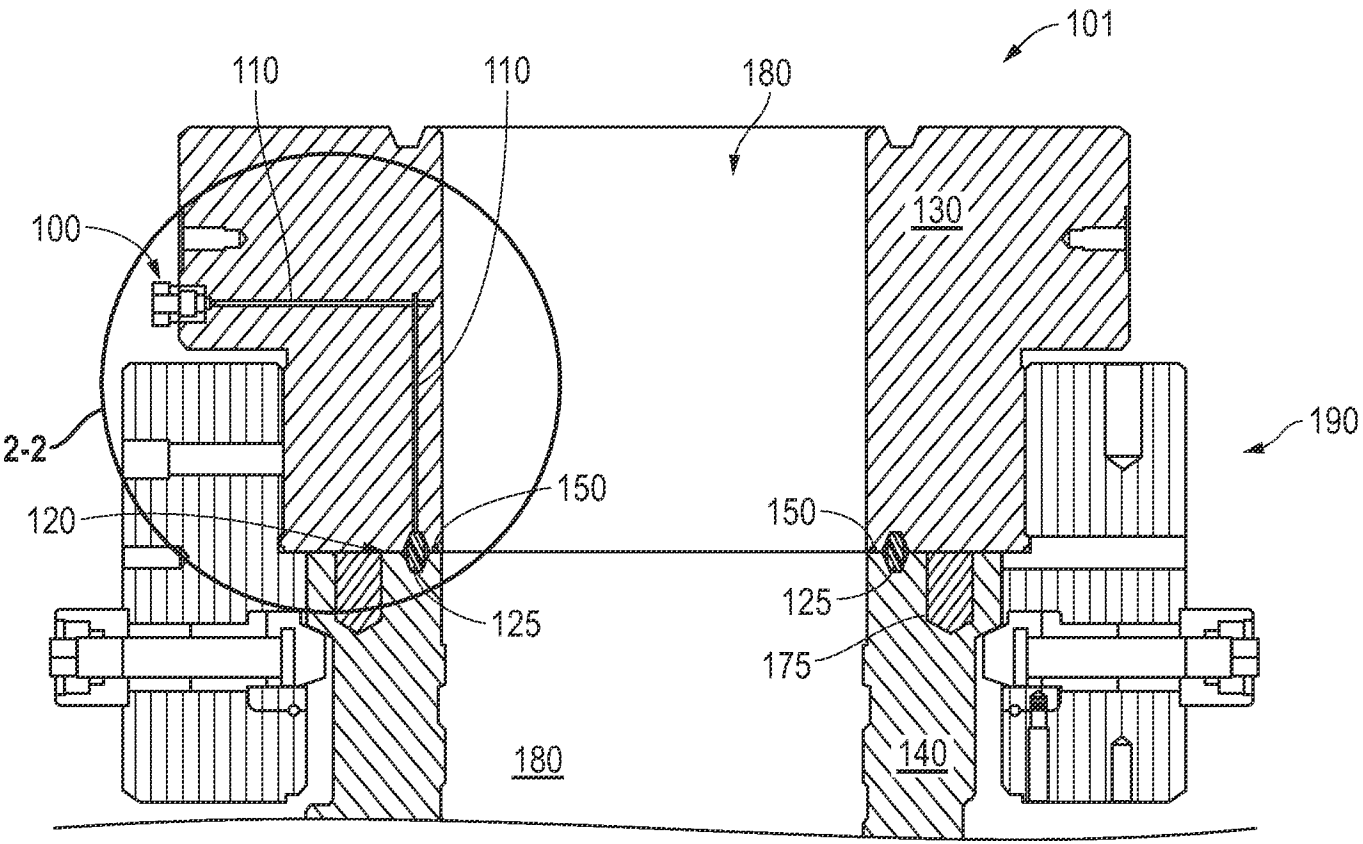
FIG. 1 is a side cross-sectional view of an embodiment of a wellhead assembly with an exterior test port for a primary seal at a wellhead interface.

Referring now to FIG. 1, a side cross-sectional view of an embodiment of a wellhead assembly 101 is illustrated with an exterior test port 100. The assembly 101 includes a wellhead 130 that is mounted to a base 140 which together define a wellbore 180 and provide a platform from which other well devices may be used to mange the wellbore 180. The wellhead 130 and base 140 meet at an interface 120 which is sealed by a primary seal 125 to prevent leakage of wellbore fluids through the potential leak path of the interface 120. In the embodiment shown, other coupling features such as a collar device 190 and guide pins 175 are provided to facilitate the mating of the wellhead 130 as described.

The noted exterior test port 100 is for the primary seal 125 at the interface 120. More specifically, the test port 100 is fluidly coupled to the seal 125 at the interface 120 by way of an intentional leak path 110. This allows for the introduction of pressure to the seal 125 to test and confirm functionality thereof. For example, as detailed further below, a portable pump 301 may be coupled to the port 100 to direct 10,000 PSI or more of pressure through the leak path 110 in order to confirm that the seal 125 is in proper working order. This is particularly beneficial because it allows for a way to test the seal 125 from an exterior location of the assembly 101 without requiring that the wellbore 180 be plugged and the more substantial undertaking of pressurizing the entire wellbore 180 above the plug.

Confirmation of the functionality of the primary seal 125 at the interface 120 means that concern over leakage of wellbore fluids from the wellbore 180 via the interface 120 during subsequent well operations may be assuaged. However, due to the configuration of the primary seal 125 and the fact that the pressure testing is directed at the seal 125 from an external location, an additional architectural feature is provided. Specifically, a secondary seal 150 is provided interior of the primary seal 125 and also at the interface 120.

With added reference to FIG. 2, as detailed below, because of the manner in which the primary seal 125 functions, this backup secondary seal 150 allows for an accurate read of the functionality of the primary seal 125 from the described pressure test. Namely, the use of the secondary seal 150 means that both an interior face 250 and an outer face 275 of the seal 150 are tested. Without the secondary seal 150, the pressure testing may falsely indicate seal failure of a functional seal 125 due to lack of sealing at the interior face 250 which is not determinative of seal functionality.

Figure 2:
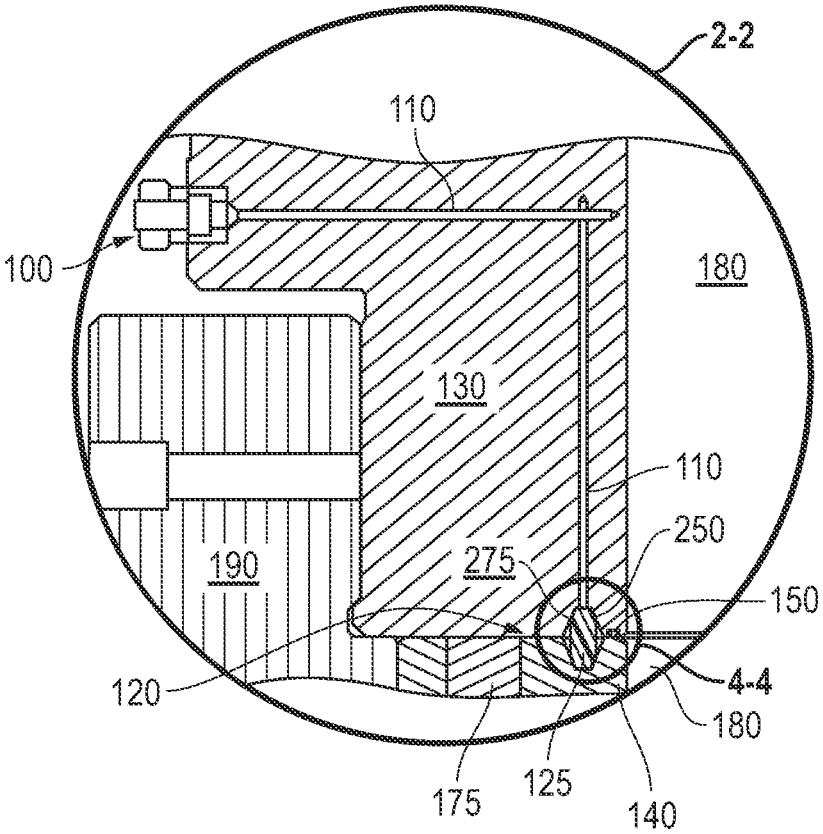
FIG. 2 is an enlarged view of the test port and wellhead interface taken from 2-2 of FIG. 1.

Referring now to FIG. 2, an enlarged view of the test port 100 and wellhead interface 120 is shown, taken from 2-2 of FIG. 1. In this depiction, the wellbore 180, defined by the wellhead 130 and base 140 is apparent, immediately adjacent the interface 120. Thus, concern over potential wellbore pressures directed at the interface 120 is apparent. It is along these lines that the primary seal 125 has been installed and set as illustrated. Setting aside the port 100, leak path 110 and secondary seal 150 for the moment, the primary seal 125 is wedged into a primary groove 450 that is defined by the interfacing wellhead 130 and base 140 (see FIG. 4). In the embodiment illustrated, it is the outer face 275 of this seal 125, sealing against the wellhead 130 and base 140 structures that provide the sealing at the interface 120 relative the wellbore 180.

Returning to the test port 100, it is possible that the application of test pressure through the leak path 110 in the wellhead 130 to the primary seal 125 would overcome the interior face 250 of the seal 125 even for a functionally set seal 125. Thus, to ensure that the outer face 275 sealing is the feature tested by the application of the port pressure, the secondary seal 150 is provided. So, for example, in circumstances where fluid pressure from the test port 100 overcomes the interior face 250, the presence of the secondary seal 150 assures that the pressure will merely be routed back to the outer face 275 of the primary seal 125. Thus, so long as the outer face 275 is in sealing engagement with the wellhead 130 and base 140, pressuring up to a predetermined level via the test port 100 is possible and the primary seal 125 will test as functional. Of course, if pressure is unable to build to the predetermined level, even with the backstop of the secondary seal 150 in place, it may mean that the outer face 275 is not maintaining the intended sealing and the primary seal 125 has not passed the pressure test.

It is worth noting that for the testing scenario described above, the pressure applied through the port 100 for testing is "predetermined". So, by way of example, where the potential pressure expected in the wellbore 180 following completion is to be over about 5,000 PSI but below about 10,000 PSI, the predetermined pressure test may be to a level of 10,000 PSI. Thus, a primary seal 125 passing the test may be rated at 10,000 PSI and considered well suited for use in the given well. Of course, wellbore pressures near the interface 120 may be higher. Thus, along these same lines, it may be possible to utilize the exterior port 100 to confirm a rating of 30,000 PSI or more for the primary seal 125.

Figure 3:
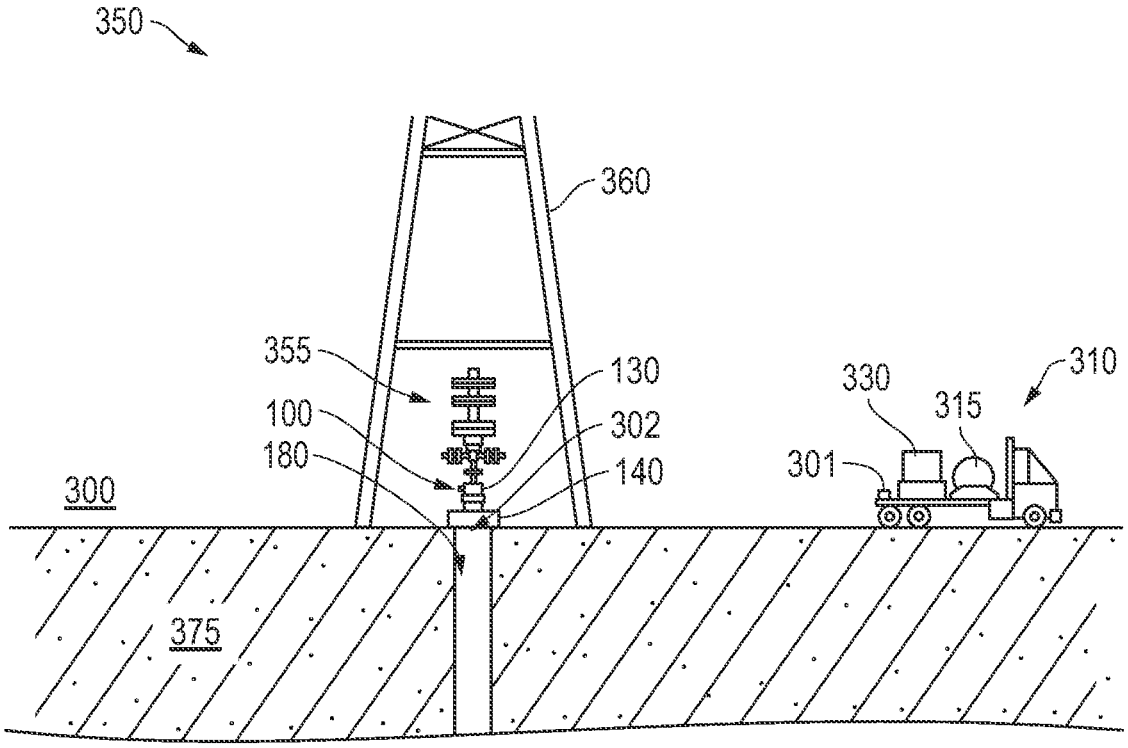
FIG. 3 is an overview schematic representation of an oilfield accommodating the wellhead assembly of FIG. 1 at a well.

Referring now to FIG. 3, an overview schematic representation of an oilfield 300 accommodating the wellhead assembly 101 of FIG. 1 at a well 302. A host of conventional equipment 350 is shown at the wellsite, including a rig 360 to help support various installations. In the embodiment shown, a Christmas tree 355 accommodating various valves and other hookups has been installed at the wellhead 130. Thus, the importance of ensuring proper internal sealing between the wellhead 130 and the base 140 is brought to mind.

In the embodiment shown, the wellbore 180 traverses a formation 375 potentially facing several thousand pounds of pressure in the vicinity of the wellhead 101. Accordingly, pressure testing as described above may be achieved by use of a handheld, portable external pump 301 that may be hooked up to the external port 100 for testing. By way of comparison, a larger pump 315 and control unit 330 of a mobile equipment truck 310 may be left in place. There is no need to plug the wellbore 180 or pressure up the well 302 internally. Thus, there is also no need to spend 8-10 hours of test time devoted to such measures. Instead, an operator may simply hook up the smaller handheld pump 301 at the test port 100 and ensure that the internal seal (e.g. the primary seal 125 of FIGS. 1 and 2), is properly set. Once confirmed, the tree 355 and other installations may ensue and operations within the well 302 may safely proceed.

Figure 4:
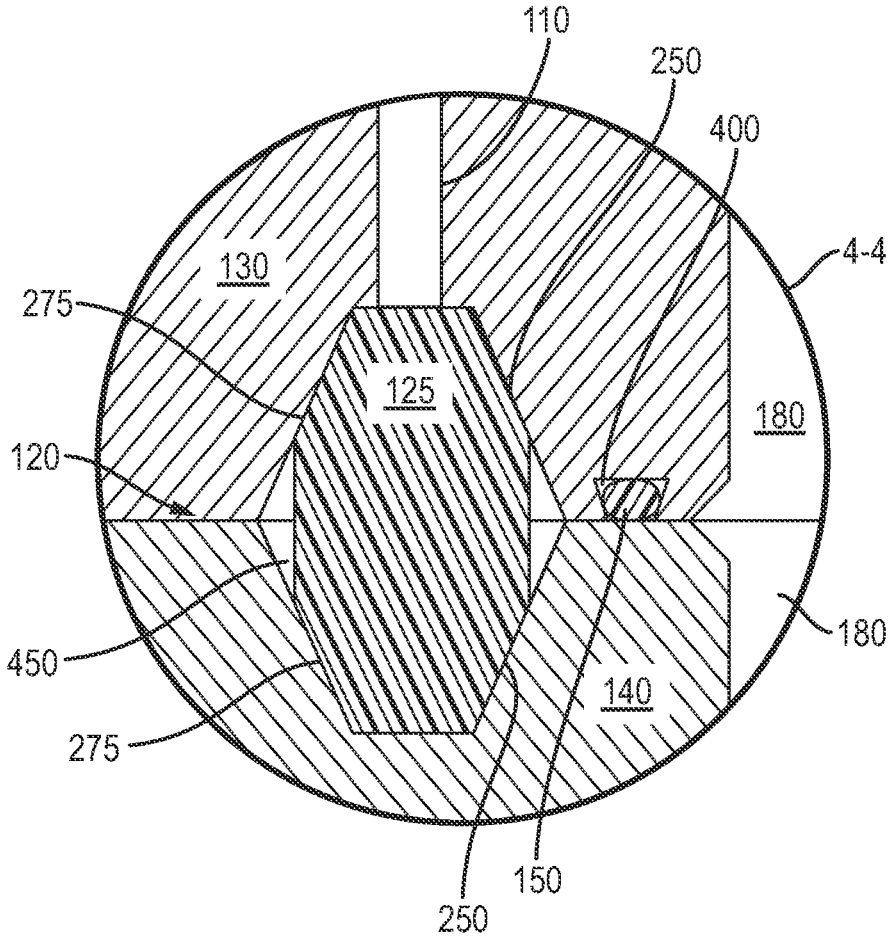
FIG. 4 is an enlarged view of the primary seal and an adjacent secondary seal taken from 4-4 of FIG. 2.

Referring now to FIG. 4, an enlarged view of the primary seal 125 and an adjacent secondary seal 150 is illustrated taken from 4-4 of FIG. 2. In this view, the intentional leak path 110 is shown intersecting the primary seal 125 in a primary groove 450 defined by the wellhead 130 and base 140 at the interface 120. It is also apparent that any fluid pressure supplied through the leak path 110 during testing as described above would be directed at both the interior face 250 and the outer face 275 of the seal 125. As indicated above, sealing by the primary seal 125 may be particular to sealing at the outer face 275. Therefore, to ensure that leakage past the interior face 250 does not serve as a false indicator of seal failure, the secondary seal 150 is provided at a location interior of the primary seal 125 at the interface 120. Thus, so long as sealing is maintained at the outer face(s) 275, pressure may be held and built up within the leak path 110 during testing as described. As a result, leakage through the interior face(s) 250 would not result in a failure designation for the seal 125.

Figure 5:
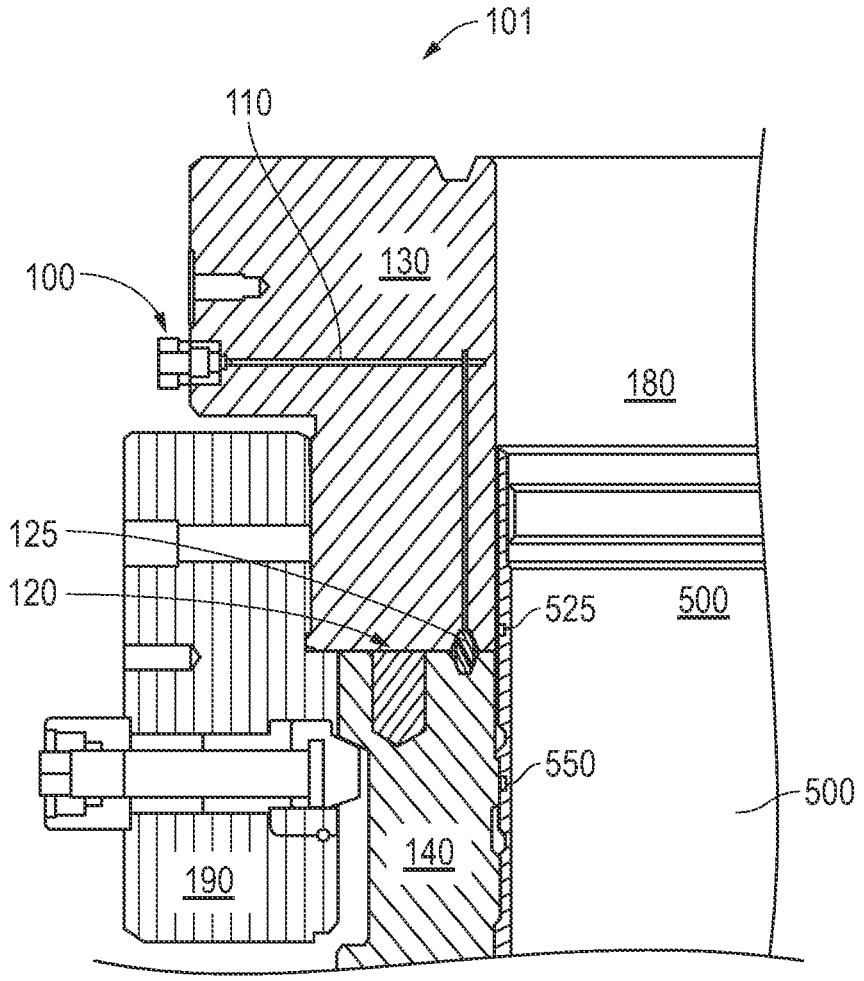
FIG. 5 is a side and partial cross-sectional view of an alternate embodiment of a wellhead assembly with an exterior test port.

Referring now to FIG. 5, a side and partial cross-sectional view of an alternate embodiment of a wellhead assembly 101 is shown, again employing an exterior test port 100. In this embodiment, a tubular 500 such as a production tubular has been installed within the wellbore. Thus, the potential for a leak path from a failing primary seal 125 continues beyond the horizontal interface 120 and to a vertical interface between the installed tubular 500 and the structure of the wellhead assembly 101 that defines the wellbore 180 (e.g. the wellhead 130 and base 140). As a result, backup sealing by a secondary seal may take place at locations of the vertical interface. Namely, as illustrated, backup sealing is achieved by an upper secondary seal 525 above the horizontal interface 120 and a lower secondary seal 550 below this interface 120. Each secondary seal 525, 550 of this embodiment is located at the vertical interface and secured by the tubular 500.

For the embodiment of FIG. 5, the secondary seals 525, 550 again achieve the function of preventing a false indication of primary seal failure during testing from the exterior port 100 should leakage through the leak path migrate past the interior face 250 even though successful sealing occurs at the outer face 275. Once more, utilizing the vertical interface for the backup sealing means that the limited space of the horizontal interface 120 is not required. So, for example, where the size and space constraints of the horizontal interface 120 are such that an effective secondary seal may be difficult to manufacture or install, this backup sealing function may be moved to the more available space of the vertical interface.

Figure 6:
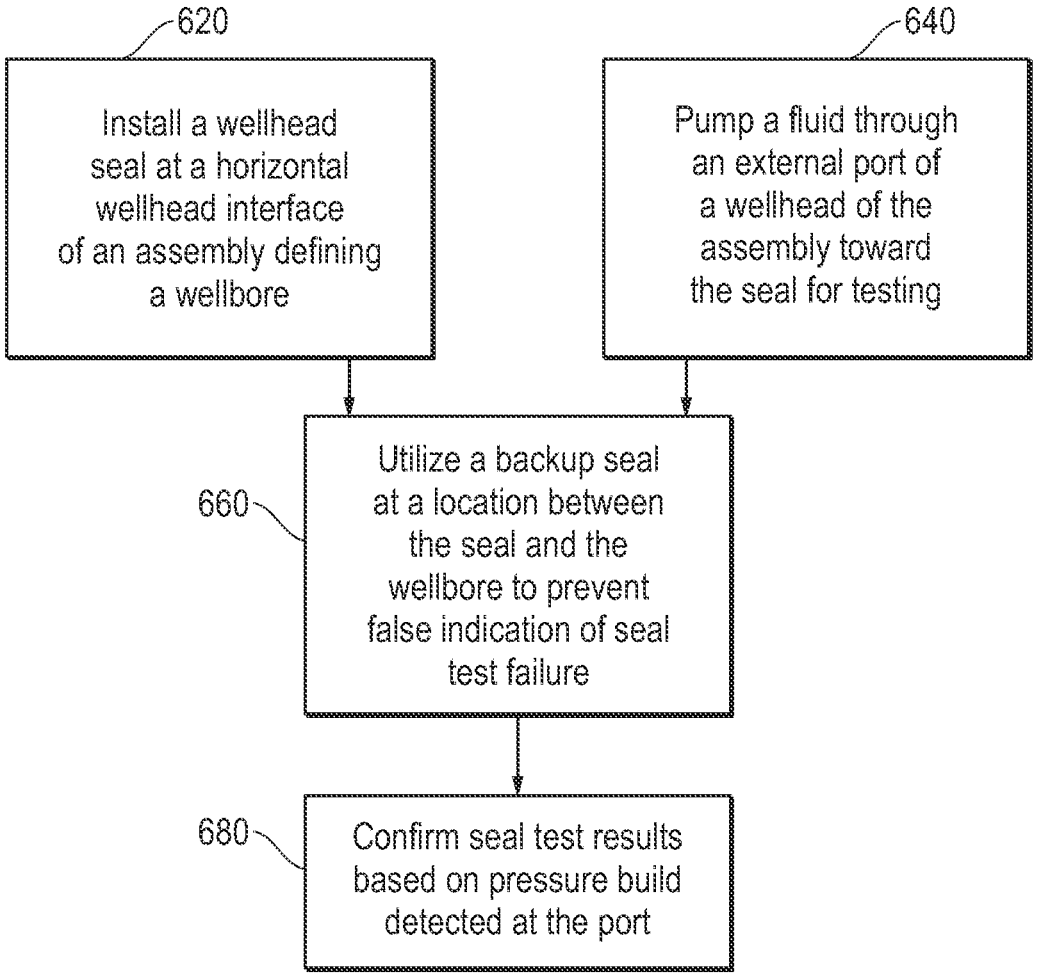
FIG. 6 is a flow-chart summarizing an embodiment of testing a primary seal at an interface of a wellhead with an exterior test port.

Referring now to FIG. 6, a flow-chart is shown summarizing an embodiment of testing a primary seal at an interface of a wellhead with an exterior test port. As indicated at 620, the wellhead seal is installed at the interface that has the potential to serve as a leak path from the wellbore that is defined by the wellhead assembly. Therefore, in order to test the seal in a manner that does not utilize the wellbore itself, a fluid may be pumped through an external port of the assembly toward the seal (see 640). Because the resulting fluid pressure is directed at the seal from an opposite direction of that of the wellbore, a backup or secondary seal may be utilized as indicated at 660. That is, to prevent a false indication of seal failure, the backup seal may be utilized to prevent leak detection when the leak would be at a face of the seal that is not actually of concern in the real world environment of preventing a wellbore leak. Thus, as indicated at 680, a true reading of test results based on the ability to pressure up through the exterior test port may be attained.

Embodiments described above provide a manner of testing a wellhead seal that avoids the more time consuming conventional techniques that require plugging and subsequent unplugging of the main wellbore. Thus, time, labor and material expenses may all be dramatically reduced. Once more, since the technique is applied externally, other aspects of installation are not impacted by way of closing off of the main bore. Thus, operators may be afforded a greater degree of flexibility in determining whether and when to proceed with other installation steps apart from testing of the wellhead seal.

The preceding description has been presented with reference to presently preferred embodiments. Persons skilled in the art and technology to which these embodiments pertain will appreciate that alterations and changes in the described structures and methods of operation may be practiced without meaningfully departing from the principle and scope of these embodiments. Furthermore, the foregoing description should not be read as pertaining only to the precise structures described and shown in the accompanying drawings, but rather should be read as consistent with and as support for the following claims, which are to have their fullest and fairest scope.

We claim:

1. A wellhead assembly comprising:

a base;

a wellhead installed at the base with a horizontal interface there between, the wellhead and base defining a vertical wellbore at an interior thereof;

a primary seal located in a groove defined by the interface for sealingly isolating fluids of the wellbore, the primary seal having an interior face and an outer face, the interior face closer to a vertical axis of the wellbore than the outer face, the faces for the sealingly isolating of the fluids;

an external test port in fluid communication with the primary seal through an intentional leak path terminating at the groove at a location between the interior and outer faces for pressure testing of the primary seal from a location exterior of the wellhead; and a secondary seal of a unitary configuration adjacently distanced from the primary seal at the horizontal interface between the base and the wellhead and further located adjacent the primary seal closer to the vertical wellbore to back up the interior face of the primary seal for the pressure testing.

2. The wellhead assembly of claim 1 wherein the external test port is configured for coupling to a handheld portable pump for the pressure testing.

3. A wellhead system comprising:

a wellhead with an external test port, the wellhead installed at a horizontal interface with a base, the interface accommodating:

a primary seal located in a groove defined by the horizontal interface for sealingly isolating fluids of a wellbore, the primary seal having an interior face and an outer faces with respect to a vertical axis of the wellbore, the interior face closer to the vertical axis than the outer face, the primary seal for the sealingly isolating of the fluids; and a secondary seal of a unitary configuration adjacently distanced from the primary seal at the horizontal interface between the base and the wellhead and located adjacent the primary seal and closer to the vertical wellbore to facilitate the pressure test; and a portable pump for coupling to the external test port to pressure test the primary seal by way of an intentional leak path through the wellhead to a location of the seal between the faces at the groove.

4. The wellhead system of claim 3 wherein the external test port is manually accessible.

5. The wellhead system of claim 4 wherein the portable pump is a handheld portable pump.

6. The wellhead system of claim 3 wherein the system is one of an onshore installation and an offshore installation.

7. The wellhead system of claim 3 further comprising a tubular installed in the wellbore along the vertical axis and in perpendicular fluid communication with the horizontal interface.

8. The wellhead system of claim 7 wherein the outer face facilitates the sealed isolation of wellbore fluids.

9. A method of pressure testing a primary seal at a horizontal interface of a wellhead and a base, the wellhead and base defining a vertical wellbore intersecting the horizontal interface, the method comprising:

coupling a portable pump to an external port at the wellhead;

pumping a pressurized fluid from the port to the primary seal through an intentional leak path to a location between an interior face to a vertical axis at a wellbore side of another outer face of the primary seal and at a groove of the horizontal interface accommodating the primary seal;

employing a secondary seal of a unitary configuration adjacently distanced from the primary seal at the horizontal interface between the base and the wellhead to backup the interior face during the pumping; and monitoring pressure generated by the pumping of the fluid.

10. The method of claim 9 wherein the outer face facilitates sealing at the horizontal interface.

11. The method of claim 9 further comprising utilizing a portable handheld pump for the pumping.

* * * * *